US008132620B2

(12) United States Patent
Hanna

(10) Patent No.: US 8,132,620 B2
(45) Date of Patent: Mar. 13, 2012

(54) TRIANGLE AIR INJECTION AND IGNITION EXTRACTION METHOD AND SYSTEM

(75) Inventor: Mohsen R. Hanna, Tampa, FL (US)

(73) Assignee: Schlumberger Technology Corporation, Sugar Land, TX (US)

( * ) Notice: Subject to any disclaimer, the term of this patent is extended or adjusted under 35 U.S.C. 154(b) by 260 days.

(21) Appl. No.: 12/356,598

(22) Filed: Jan. 21, 2009

(65) Prior Publication Data

US 2010/0155060 A1 Jun. 24, 2010

Related U.S. Application Data

(60) Provisional application No. 61/139,067, filed on Dec. 19, 2008.

(51) Int. Cl.
*E21B 43/24* (2006.01)
*E21B 43/243* (2006.01)

(52) U.S. Cl. ..... 166/245; 166/50; 166/52; 166/261; 166/272.1; 166/272.7; 166/401

(58) Field of Classification Search ..... None
See application file for complete search history.

(56) References Cited

U.S. PATENT DOCUMENTS

| | | | | | |
|---|---|---|---|---|---|
| 2,365,591 | A | * | 12/1944 | Ranney | 166/269 |
| 3,149,670 | A | * | 9/1964 | Grant | 166/259 |
| 4,384,613 | A | * | 5/1983 | Owen et al. | 166/256 |
| 4,410,216 | A | * | 10/1983 | Allen | 299/2 |
| 4,574,884 | A | * | 3/1986 | Schmidt | 166/263 |
| 4,598,770 | A | * | 7/1986 | Shu et al. | 166/245 |
| 4,722,395 | A | | 2/1988 | Venkatesan | |
| 4,850,429 | A | * | 7/1989 | Mims et al. | 166/245 |
| 5,211,230 | A | * | 5/1993 | Ostapovich et al. | 166/245 |
| 5,273,111 | A | * | 12/1993 | Brannan et al. | 166/245 |
| 5,339,897 | A | * | 8/1994 | Leaute | 166/245 |
| 5,456,315 | A | * | 10/1995 | Kisman et al. | 166/245 |

(Continued)

FOREIGN PATENT DOCUMENTS

CA 2176639 8/2000

(Continued)

OTHER PUBLICATIONS

Alajmi et al, "Heavy oil displacement by thermal recovery using different horirzontal/vertical wells" SPE 106347, 2006 SPE Technical Symposium of Saudi Arabia Section held in Dhahran, Saudi Arabia, May 21-23, 2006, 10 pages.

(Continued)

*Primary Examiner* — George Suchfield

(57) ABSTRACT

The present invention is a process for recovering oil from an underground oil-containing reservoir. The process includes providing one or more injection wells for injecting a gaseous fluid (steam and air) into the reservoir, the one or more injection wells having a plurality of generally horizontal injector legs, the injector legs positioned within a first depth region in the reservoir. The process further includes providing one or more extraction wells for recovering oil from the reservoir, the one or more extraction wells having plurality of generally horizontal extractor legs, the extractor legs positioned within a second depth region in the reservoir below the first depth region and spaced between the injector legs. Gaseous fluid, typically steam, is injected through the injector legs for a first period of time; and then air is injected through at least one of the injector legs. Alternative embodiments of the invention are also described.

11 Claims, 4 Drawing Sheets

U.S. PATENT DOCUMENTS

| | | | | |
|---|---|---|---|---|
| 5,626,191 | A | 5/1997 | Greaves | |
| 6,142,557 | A | 11/2000 | Rooijakkers | |
| 7,343,971 | B2 | 3/2008 | Pfefferle | |
| 2006/0162922 | A1 * | 7/2006 | Chung et al. | 166/245 |
| 2008/0264635 | A1 * | 10/2008 | Chhina et al. | 166/260 |
| 2009/0188667 | A1 * | 7/2009 | Lim et al. | 166/256 |

FOREIGN PATENT DOCUMENTS

| | | | |
|---|---|---|---|
| RU | 2287677 | C1 | 11/2006 |
| RU | 2005139988 | A | 6/2007 |
| RU | 2360105 | C2 | 6/2009 |
| WO | WO 2006074555 | A1 * | 7/2006 |

OTHER PUBLICATIONS

Chan et al, "Effects of well placement and critical operating conditions on the performance of dual well SAGD well pair in heavy oil reservoir", SPE 39082, Fifth Latin American and Caribbean Petroleum Engineering Conference and Exhibition held in Rio de Janeiro, Brazil, Aug. 30-Sep. 3, 1997, 11 pages.

S. Das, "Improving the performance of SAGD" SPE/PS-CIM/CHOA 97921, 2005 SPE International Thermal Operations and Heavy Oil Symposium held in Calgary, Alberta, Canada, Nov. 1-3, 2005, 8 pages.

Escobar et al, "Optimization methodology for cyclic steam injection with horizontal wells", SPE/Petroleum Society of CIM 65526, 2000 SPE/Petroleum Society of CIM International Conference on Horizontal Well Technology held in Calgary, Alberta, Canada, Nov. 6-8, 2000, 12 pages.

Gaviria et al, "Pushing the boundaries of artificial lift applications: SAGD ESP installations in Canada", SPE 110103, 2007 SPE Annual Technical Conference and Exhibition held in Anaheim, California, USA, Nov. 11-14, 2007, 15 pages.

Mendoza et al, "SAGD, Pilot test in Venezuela", SPE 53687, Sep. 1999 Latin American and Caribbean Petroleum Engineering Conference held in Caracas, Venezuela, Apr. 21-23, 1999, 11 pages.

Nasr et al, "SAGD Operating strategies", SPE 50411, 1998 SPE International Conference on Horizontal Well Technology held in Calgary, Alberta, Canada Nov. 1-4, 1998, 14 pages.

Polikar et al, "Fast-SAGD: half the wells and 30% less steam", SPE/Petroleum Society of CIM 65509, 2000 SPE/Petroleum Society of CIM International Conference on Horizontal Well Technology held in Calgary, Alberta, Canada Nov. 6-8, 2000, 6 pages.

George Scott, "Comparison of CSS and SAGD performance in the clearwater formation at Cold Lake", SPE/Petrleum Society of CIM/CHOA 79020, 2002 SPE International Thermal Operations and Heavy Oil Symposium and International Horizontal Well Technology Conference held in Calgary, Alberta, Canada, Nov. 4-7, 2002, 12 pages.

C. Shen, "Numerical investigation of SAGD process using a single horizontal well", SPE 50412, 1998 SPE International Conference on Horizontal Well Technology held in Calgary, Alberta, Canada, Nov. 1-4, 1998, 10 pages.

Shin et al, "Optimizing the SAGD process in three major Canadian oil-sands areas", SPE 95754, 2005 SPE Annual Technical Conference and Exhibition held in Dallas, Texas, USA, Oct. 9-12, 2005, 11 pages.

* cited by examiner 122.0042 US NP

TRIANGLE AIR INJECTION AND IGNITION EXTRACTION METHOD AND SYSTEM

CROSS REFERENCE TO RELATED APPLICATION

This application claims priority to Provisional Patent Application No. 61/139,067, filed Dec. 19, 2008.

FIELD OF THE INVENTION

The disclosure relates in general to reservoir development, and more particularly to an improved method and system to extract oil from a reservoir.

BACKGROUND OF THE INVENTION

In a Conventional SAGD (Steam Assisted Gravity Drainage) configuration, a "dual well" process includes the horizontal drilling of two parallel wells one above the other. The upper well is dedicated to continuous steam injection and the lower well is for recovering reservoir fluids. The separation between the injector well and the producer well and the separation between the well pairs are a function of the reservoir and oil properties.

In a Single-Well SAGD (SW-SAGD) configuration, only one horizontal well is used for both injection and production. This configuration, under the same operating conditions as Conventional SAGD, suffers from excessive steam production at the facilities. An alternate configuration is to place vertical steam injectors above or between the horizontal extractors.

In a Triangle SAGD (TRI-SAGD) configuration, horizontal injectors are drilled halfway between the horizontal producers with the injectors positioned above the producers. TRI-SAGD is acknowledged to require the minimum number of wells for SAGD.

The THAI (Toe to Heel Air Injection) process is disclosed in Canadian Patent No. 2,176,639, by Petrobank Energy Ltd, a Calgary Canada Company. FIG. 1 shows how the THAI process works. In the THAI process air injection/ignition takes place from a vertical well 11. The arrows 12 show the injection of air. The air and fuel content combust forming a fire front 13. The fire front 13 heats up the cold crude and the reservoir fluids 15 (gas and liquids) are recovered from a horizontal leg 14A of an extraction well 14.

There is a need for an improved oil recovery process, one that increases extraction efficiency and uses less energy than conventional methods. The present invention provides such a solution.

SUMMARY OF THE INVENTION

The present invention is a process for recovering oil from an underground oil-containing reservoir. The process includes providing one or more injection wells for injecting a gaseous fluid (typically steam and then air or steam with additives and then air) into the reservoir, the one or more injection wells having a plurality of generally horizontal injector legs, the injector legs positioned within a first depth region in the reservoir. The process further includes providing one or more extraction wells for recovering oil from the reservoir, the one or more extraction wells having a plurality of generally horizontal extractor legs, the extractor legs positioned within a second depth region in the reservoir below the first depth region and spaced between the injector legs. Gaseous fluid, typically steam (or steam and additives to steam), is injected through the injector legs for a first period of time; and then air is injected through at least one of the injector legs.

A primary aspect of the invention is the initiation of a wet combustion process for recovering oil from an underground oil-containing reservoir. The process provides one or more injection wells in the reservoir, the one or more injection wells having a plurality of generally horizontal injector legs positioned within a first depth region in the reservoir. The process provides one or more extraction wells for recovering oil from the reservoir, the one or more extraction wells having a plurality of generally horizontal extractor legs and positioned within a second depth region in the reservoir below the first depth region and spaced between the injector legs. The extractor legs could be multi-laterals. Steam is injected through the one or more injection wells for a first period of time and then air is injected through at least one of the injection wells after the first period of time. The air initiates and propagates a combustion front, whereby oil from the reservoir is recovered from the extraction wells.

A further aspect of the present invention is a system for recovering oil from an underground oil-containing reservoir. The system includes one or more injection wells positioned in the reservoir, the one or more injection wells having at least one injector completion interval, the at least one injector completion interval positioned within a first depth region in the reservoir. The system includes one or more extraction wells positioned in the reservoir, the one or more extraction wells having at least two generally horizontal extractor legs, the at least two extractor legs positioned within a second depth region in the reservoir below the first depth region, and positioned on opposite sides of the at least one injector completion interval. A steam injector for injecting steam through the at least one injection well for first period of time is provided. An air injector for injecting air through the at least one injection well after the first period of time is provided. The air initiates and propagates a combustion front after injection, whereby oil from the reservoir is recovered from the one or more extraction wells.

BRIEF DESCRIPTION OF THE DRAWINGS

The disclosure is illustrated by way of example and is not intended to be limited by the figures of the accompanying drawings in which like references indicate similar elements and in which.

DETAILED DESCRIPTION OF THE DISCLOSURE

Figure 1:
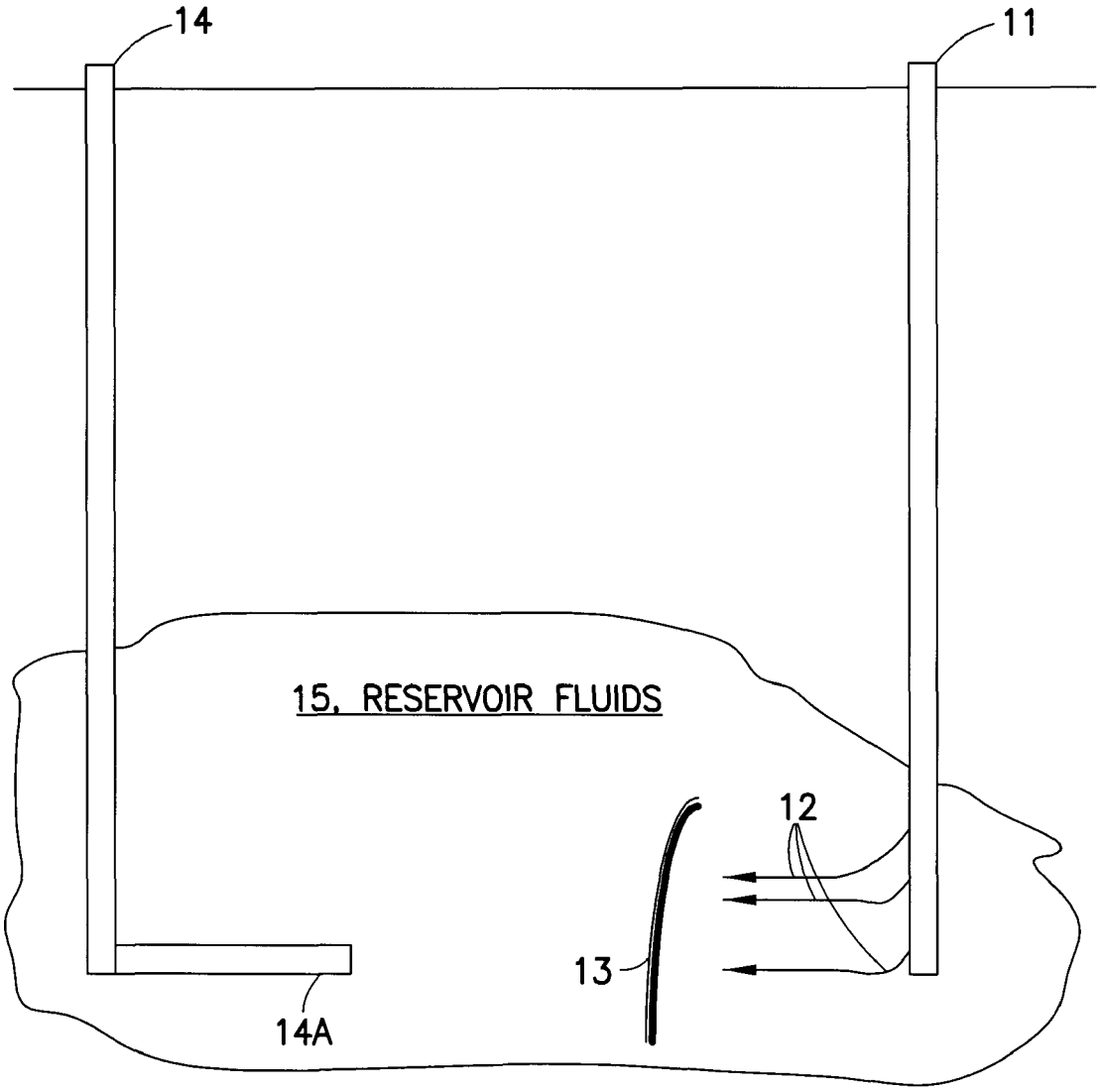
FIG. 1 PRIOR ART
FIG. 1 shows the toe-to-heel air injection system for recovering oil from a reservoir.

Advantages and features of the present invention may be understood more readily by reference to the following detailed description of illustrative embodiments and the accompanying drawings. The present invention may, however, be embodied in many different forms and should not be construed as being limited to the embodiments set forth herein. Rather, these embodiments are provided so that this disclosure will fully convey the concept of the invention to those skilled in the art, and the present invention will only be defined by the appended claims. Like reference numerals refer to like elements throughout the specification.

The present disclosure is a modification of the triangle steam assisted gravity drainage (TRI-SAGD) system. Using a similar layout for the injection wells and the recovery (also referred to as producer or extraction) wells, the present disclosure injects steam or steam with additives such as naptha, carbon dioxide, and/or solvents like propane or other petroleum distillates into one or more injection wells for a first period of time, which allows extraction of oil from the one or more recovery wells in a typical fashion. After the period of time, the injection of steam is stopped and air is then injected, typically through the interior or "middlemost" injector well or wells (i.e. a well or group of wells that have other injection wells on opposite sides). As used throughout this application, the term "air" includes any type of gaseous fluid that is predominantly air, such as a mixture of air and oxygen or other additives that would promote combustion, or air from which some or all of certain component gases (such as nitrogen) have been removed. The air may be preheated prior to injection, such as by being warmed by passing the air and flue gases through a heat exchanger.

Due to the presence of water during steam injection, air injection initiates a sustainable wet combustion which forces oil toward the one or more recovery wells for extraction. The wet combustion that occurs in the TRI-SAGD configuration requires a special design that allows the initiation of a sustainable TRiangle Air Injection (TRAI) process. In brief, at an optimal time, a specially designed TRI-SAGD configuration is converted to TRAI.

Efficient implementation of TRI-SAGD and ignition of the oil through the injection of air, mostly targets heavy crude reservoirs where oil viscosity and reservoir conditions do not require heat up periods for establishing communication between the injectors and the producers and allow for large separation between the injector wells and the producer wells. In other words, the TRI-SAGD followed by TRAI is mostly typically the most efficient in the Venezuelan Orinoco belt and other similar environments. Nevertheless, with special considerations geared towards speeding up the heat up period; ignition of TRI-SAGD is still feasible in extremely viscous conditions such as the Canadian Athabasca Oil Sands.

Ignition at optimal time (within the first 3 years under certain subsurface conditions) of a specially designed Triangle Steam Assisted Gravity Drainage (TRI-SAGD) is a key component of the present disclosure.

Figure 2:
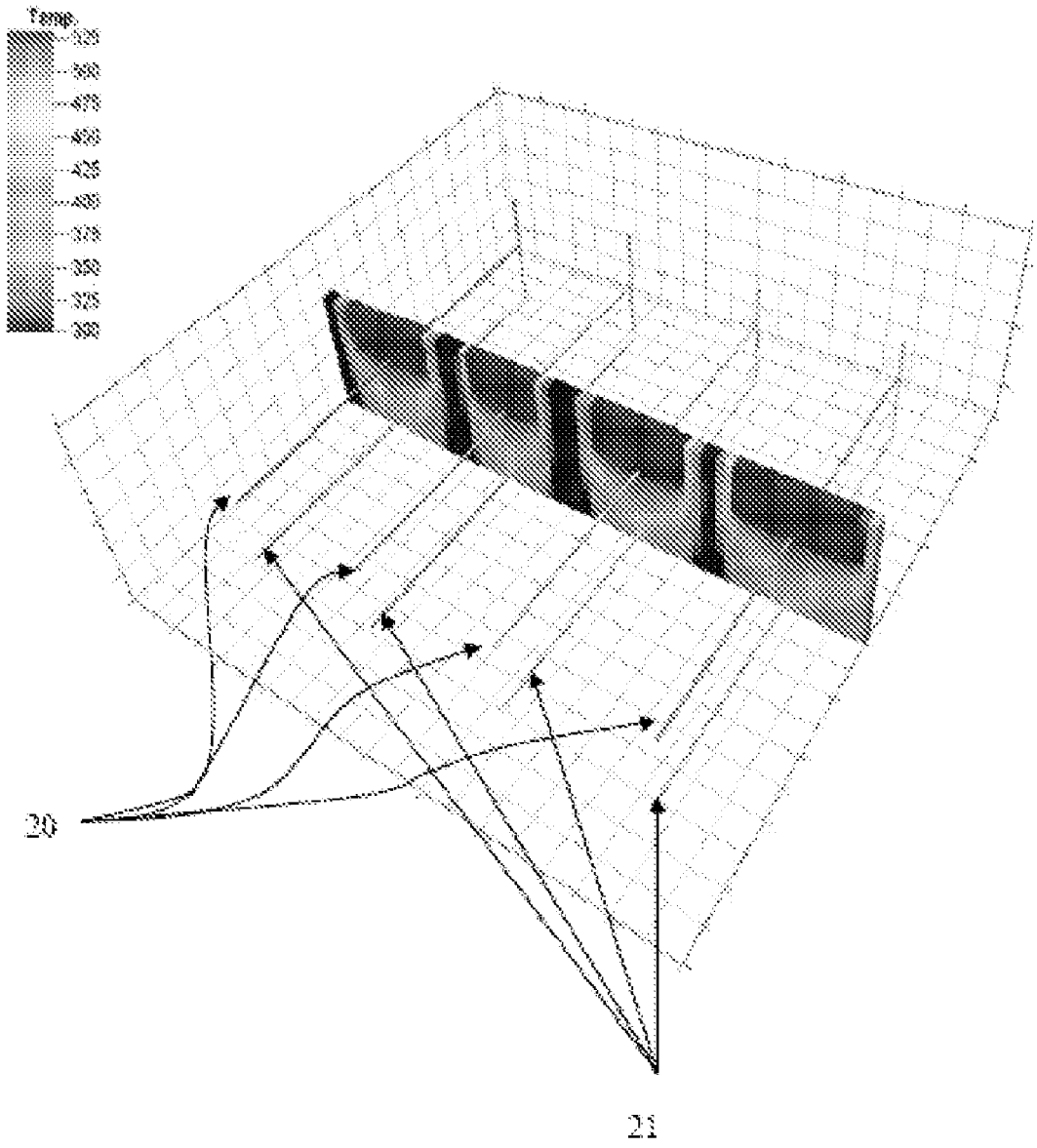
Figure 2 Prior Art
FIG. 2 shows a three dimensional diagram of a conventional Steam Assisted Gravity Drainage (SAGD) system for recovering oil from a reservoir.

FIG. 2 shows a Conventional SAGD configuration. In a Conventional SAGD, the horizontal injector 20 is located above the horizontal producer (e.g. 21). In this configuration steam is injected from the upper horizontal wells 20 which create steam chambers that heat up and drain oil toward the lower horizontal wells 21 for extraction. FIG. 2 shows the temperature profile of an operating SAGD well. The temperature is highest around and above the injectors 20. The temperature is lowest at the point between two adjacent injectors.

Figure 3:
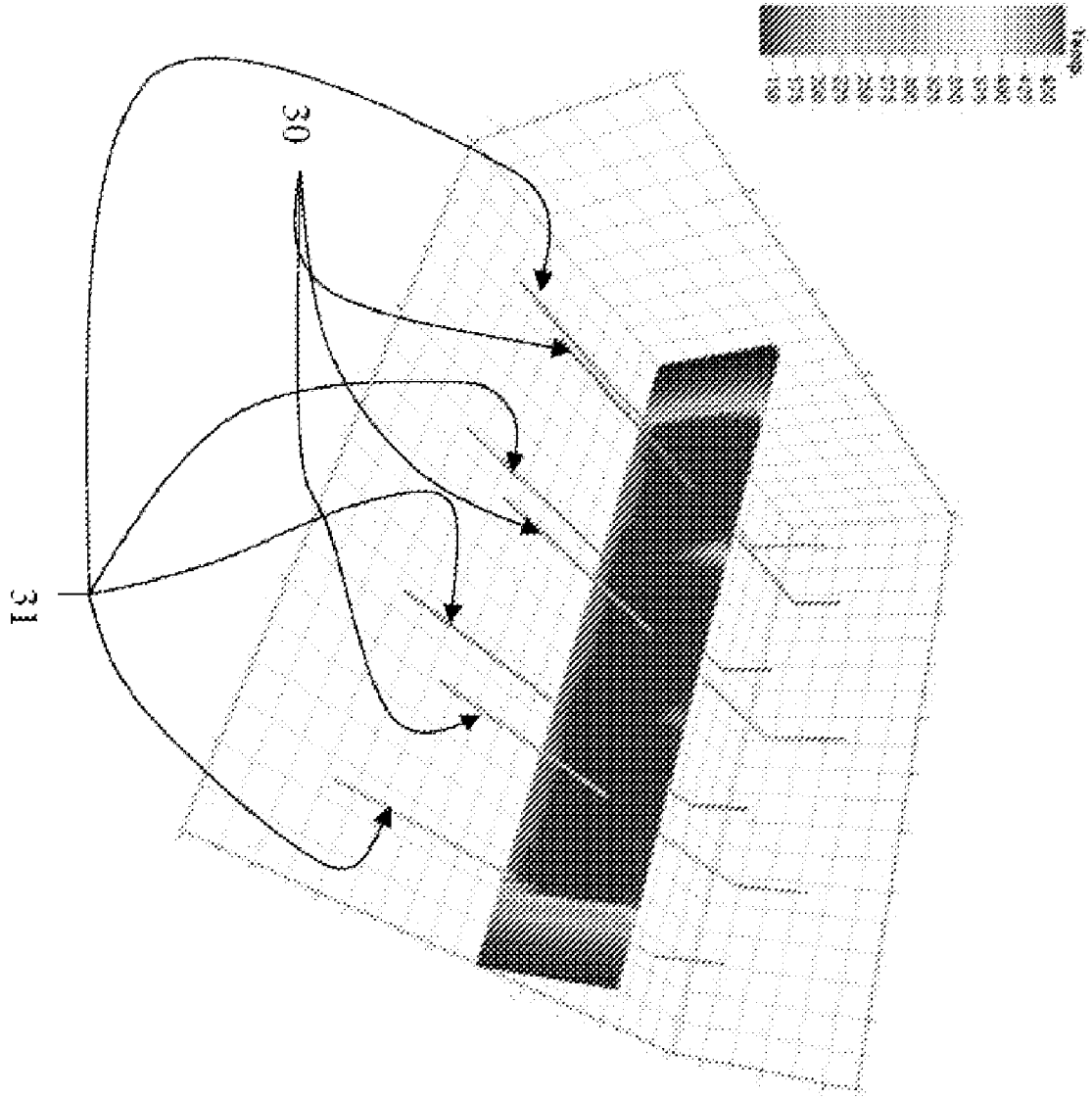
FIG. 3 shows a three dimensional diagram of a Triangle Steam Assisted Gravity Drainage (TRI-SAGD) system for recovering oil from a reservoir.

In a TRI-SAGD, shown in FIG. 3, the horizontal injectors 30 are placed approximately halfway between the horizontal producers 31. From FIG. 3, one can easily visualize the superiority of TRI-SAGD. Heat propagation is superior with no cold pockets as observed in conventional SAGD configuration (FIG. 2). The configuration of TRI-SAGD allows operation of the producers at a much lower bottom hole operating pressure without steam production at the facilities. Thus for the same time frame, TRI-SAGD would result in better steam propagation, improved oil recovery, lower steam oil ratio and enhanced economics. The TRI-SAGD oil production usually outperforms Conventional SAGD. This superiority is noticeable during the early years where impact on economics is mostly felt. Accordingly, early ignition of a TRI-SAGD configuration makes a valid economical consideration. For the Venezuelan reservoir that was used in this evaluation, in a 10 year time frame, the estimated recovery factor for TRI-SAGD is almost 10% higher than Conventional SAGD.

Figure 4:
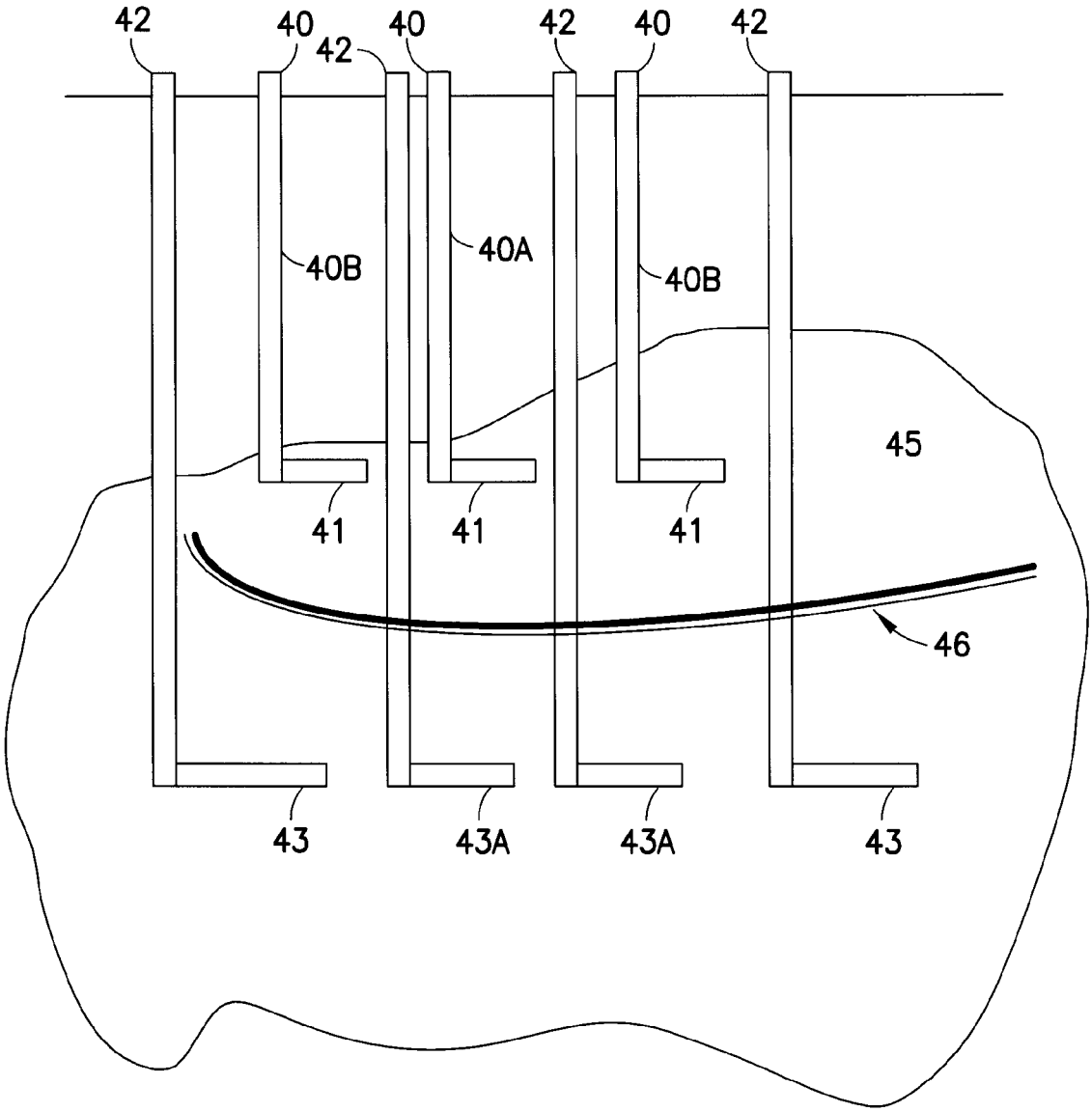
FIG. 4 shows an oil recovery system of the present invention.

FIG. 4 shows the proposed Triangle Air Injection (TRAI) technology. The process has to be designed and tailored for every reservoir. FIG. 4 shows injector wells 40 having substantially horizontal legs 41 within a first depth region and extractor wells 42 having substantially horizontal legs 43 and 43A within a second depth region, the second depth region being deeper than the first depth region. FIG. 4 depicts a similar perspective of the type of well arrangement shown in FIG. 3 where three injector well horizontal legs (30, 41) are located above and between four extractor well horizontal legs (31, 43). It is not necessary for the substantially horizontal legs 41 to be located at the same depth, only that they be located in the same general first depth region. Similarly it is not necessary for the substantially horizontal legs 43 and 43A to be located at the same depth, only that they be located in the same general second depth region that is deeper than the first depth region. The injector wells horizontal legs 41 are vertically offset from the extractor wells horizontal legs 43 and 43A and placed approximately halfway between the extractor legs 43 and 43A.

While each injector well 40 in FIG. 4 is shown having a single substantially horizontal leg 41 and each extractor well 42 is shown having a single substantially horizontal leg 43, it should be understood that each injector well 40 and extractor well 42 may alternatively have two or more horizontal legs and the layout of the horizontal legs may be different (horizontal legs may branch in different directions from the primary wellbores, etc.). Similarly, while FIG. 4 depicts a two dimensional view of a layout that is preferred under certain downhole conditions consisting of three injector wells spaced above and between four extractor wells, the disclosed method is not limited to the use of this particular layout.

It is possible, for instance, to drill two or more extractor well horizontal legs 43 and one or more injector well horizontal leg 41 from a single drilling pad. Alternatively it is possible to drill the injector well(s) 40 and extractor well(s) 42 from different drilling pads. In some embodiments, these drilling pads will be located on opposite sides of the subsurface area being produced. In this situation, the extractor well horizontal legs 43 could be drilled (for instance) from east to west while the injector well horizontal leg(s) 41 could be drilled above and between the extractor well horizontal legs 43 from west to east. In this type of layout, the toes of the injector well horizontal leg(s) 41 can be near the heels of the extractor well horizontal legs 43 and vice versa. Particularly when the reservoir thickness is uneven in the area being produced, it is possible to replace injector wells horizontal leg(s) 41 with one or more non-horizontal (i.e. vertical or deviated) injector completion intervals. As used throughout this application, the phrase "injector completion interval" comprises horizontal legs, deviated completion intervals, and/or vertical completion intervals.

At an optimal time (typically within the first 3 years for certain types of subsurface conditions) a specially designed TRI-SAGD configuration is converted to TRAI. To do so, typically one or more interior or "middlemost" steam injector wells 40A are converted to air injectors. The injected air typically enters the reservoir along the length of one or more steam injectors 40A. Because the reservoir liquids 45 are already hot (following steam injection), self ignition takes place and the resulting combustion forms a combustion front 46 that pushes the oil toward the horizontal legs 43, 43A of extractor wells 42. The inner extractor well horizontal legs 43A are used as short term producers and when oil extraction is minimal, the inner extractor well horizontal legs 43A could be used as observation wells or simply shut down.

The outer ex-steam injectors 40B can be used to recover flue gas. So instead of producing all the reservoir fluids 45 (oil and flue gases) from one well, as is in the case of THAI, in a TRAI process the reservoir acts as a separator with flue gas produced from the upper wells (ex-steam injectors 40B) and oil production taking place from the lower horizontal legs 43 and 43A of wells 42. The use of separate wells to produce the gases and liquids results in fewer burdens on the production facilities. In addition, the TRAI process allows better control of the fire front 46. The presence of producer wells on both sides of the fire front 46 helps to anchor the fire front and control its movement. It should be noted that in a full field scenario, the presented element of symmetry repeats itself. Otherwise, when sufficient reservoir fluids 45 from this subsurface area have been recovered, wells 40 and 42 are abandoned (shut in) and similar (often nearly identical) wells are drilled nearby to produce oil from nearby subsurface areas.

The optimum time to switch from steam to air is function of a variety factors. Some of these factors include; reservoir depth, initial reservoir pressure and temperature and reservoir thickness. Reservoir characteristics such as; horizontal permeability, horizontal to vertical permeability, rock thermal properties, oil properties such as viscosity and relative permeability curves impact the optimum time to switch from steam injection to air injection.

The configuration and design of the wells including the separation between the injector wells, the separation between the extractor wells and the vertical separation between the extractor and injector wells needs to be considered. Other factors such as steam quality, steam injection rates, wellbore heat losses, and fluid production rates also impact the switchover. The presence of an aquifer or gas cap can also affect heat losses and have an impact on constraints imposed on the extractor wells thus impact the switch from steam to air injection. Needless to say, numerical modeling and optimization is typically needed for every situation.

A further advantage of the present disclosure is that during TRI-SAGD production, facilities and pipelines are coated with heavy crude, thus corrosion problems are less when air injection starts and TRI-SAGD is converted to TRAI.

Another important advantage of the TRAI over the THAI, is the presence of water at the time of ignition. Presence of water will result in a wet combustion process with superior oil mobility and recovery, than dry combustion.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the disclosure has been particularly shown and described with reference to illustrative embodiments thereof, it will be understood by those of ordinary skilled in the art that various changes in form and details may be made therein without departing from the spirit and scope of the present invention as defined by the claims. In addition, those of ordinary skill in the art appreciate that any arrangement which is calculated to achieve the same purpose may be substituted for the specific embodiments shown and that the invention has other applications in other environments.

What is claimed is:

1. A process for recovering oil from an underground oil-containing reservoir, comprising:

providing one or more injection wells for injecting a gaseous fluid into the reservoir, said one or more injection wells having a plurality of generally horizontal injector legs, said injector legs positioned within a first depth region in the reservoir;

providing one or more extraction wells for recovering oil from the reservoir, said one or more extraction wells having a plurality of generally horizontal extractor legs, said extractor legs positioned within a second depth region in the reservoir below the first depth region and spaced between the injector legs;

injecting gaseous fluid through the injector legs for a first period of time; and injecting air through at least one of the injector legs after the first period of time.

2. The process according to claim 1, wherein the injector legs are vertically offset from the extractor legs.

3. The process according to claim 1, wherein the injector legs are placed approximately halfway between the extractor legs.

4. The process according to claim 1, wherein the injected gaseous fluid is steam or steam and additives to steam.

5. The process according to claim 1, wherein the underground oil-containing reservoir comprises a heavy crude reservoir.

6. The process according to claim 1, wherein the first period of time is determined from factors selected from the group consisting of: reservoir depth, reservoir pressure, reservoir temperature, reservoir thickness, horizontal to vertical permeability of the reservoir, oil viscosity, distance between the one or more injection wells, distance between the one or more extraction wells, distance between the one or more extraction and the one or more injection wells, steam quality, steam injection rates, wellbore heat losses, and fluid production rates.

7. A wet combustion process for recovering oil from an underground oil-containing reservoir, comprising:

providing one or more injection wells in the reservoir, said one or more injection wells having a plurality of generally horizontal injector legs, said injector legs positioned within a first depth region in the reservoir;

providing one or more extraction wells for recovering oil from the reservoir, said one or more extraction wells having a plurality of generally horizontal extractor legs, said extractor legs positioned within a second depth region in the reservoir below the first depth region and spaced between the injector legs;

injecting steam or steam and additives to steam through the one or more injection wells for a first period of time; and injecting air through at least one of said one or more injection wells after the first period of time wherein air initiates and propagates a combustion front, whereby oil from the reservoir is recovered from the extraction wells.

8. The process according to claim 7, wherein the injector legs are vertically offset from the extractor legs.

9. The process according to claim 7, wherein the injector legs are placed approximately halfway between the extractor legs.

10. The process according to claim 7, wherein the first period of time is determined from factors selected from the group consisting of: reservoir depth, reservoir pressure, reservoir temperature, reservoir thickness, horizontal to vertical permeability of the reservoir, oil viscosity, distance between the one or more injection wells, distance between the one or more extraction wells, distance between the one or more extraction and the one or more injection wells, steam quality, steam injection rates, wellbore heat losses, and fluid production rates.

11. The process according to claim 7, wherein the underground oil-containing reservoir comprises a heavy crude reservoir.

* * * * *